United States Patent [19]
Magnet
[11] 4,228,110
[45] Oct. 14, 1980

[54] GASOLINE PRIMING PUMP FOR CARBURETORS

[76] Inventor: Melvin Magnet, P.O. Box 521, Pico Rivera, Calif. 90660

[21] Appl. No.: 45,101

[22] Filed: Jun. 4, 1979

[51] Int. Cl.³ ..... F02M 1/16

[52] U.S. Cl. ..... 261/37; 261/DIG. 8; 123/187.5 R; 417/437

[58] Field of Search ..... 261/DIG. 8, 37, 34 R; 123/187.5 R; 417/437

[56] References Cited

U.S. PATENT DOCUMENTS

| | | | |
|---|---|---|---|
| 193,550 | 7/1877 | Redman | 417/437 |
| 1,264,954 | 5/1918 | Maltby | 261/DIG. 8 |
| 1,520,552 | 12/1924 | Adams | 261/DIG. 8 |
| 2,612,173 | 9/1952 | Gustafson | 417/437 |
| 3,064,430 | 11/1962 | Reynolds | 92/194 |
| 3,275,305 | 9/1966 | Nutten | 261/DIG. 8 |
| 3,323,293 | 6/1967 | Santi | 261/DIG. 8 |
| 3,338,565 | 8/1967 | Heid | 123/187.5 R |
| 3,345,045 | 10/1967 | Tuggle | 261/DIG. 8 |
| 3,908,689 | 9/1975 | Wingate | 417/437 |

*Primary Examiner*—Tim R. Miles
*Attorney, Agent, or Firm*—Edgar W. Averill, Jr.

[57] ABSTRACT

A combination gasoline priming pump and gasoline overflow drain for use on carburetors. The pump has a cylindrical body having an axial cylindrical bore. The bore is closed at its upper end and has an opening at its lower end. A hollow tube extends through the opening and a piston is connected to the upper end thereof. A conduit connects the upper end of the cylindrical bore with the carburetor body.

10 Claims, 5 Drawing Figures

GASOLINE PRIMING PUMP FOR CARBURETORS

BACKGROUND OF THE DISCLOSURE

The field of the invention is carburetor improvements, and the invention relates more specifically to a combination gasoline priming pump and gasoline overflow drain for carburetors. The invention even more specifically relates to carburetors for use on motorcycles or other devices which the operator is in proximity to the carburetor during the starting operation.

For many types of carburetors, a substantial air-through-put is required to initiate the flow of gasoline into the venturi of the carburetor. Because of this, it is often difficult to start motors having such carburetors. This is particularly true for devices which do not have electric starters and more specifically this is true for motorcycles which have kick-starters.

A second difficulty exists when the valve needle sticks in the fuel seat and gasoline continues to enter the bowl of the carburetor. This often leads to a washdown of the engine which in turn creates a fire hazard. There is thus a need for a vent to prevent this hazard.

SUMMARY OF THE INVENTION

It is an object of the present invention to provide a combination gasoline priming pump and gasoline overflow drain for use on carburetors.

The present invention is for a combination gasoline priming pump and gasoline overflow drain for use on carburetors which pump has a cylindrical body with an axial cylindrical bore. The bore is closed at its upper end and has an air exit and gasoline entry conduit affixed to the cylindrical body and extending into the bore near the upper end thereof. The pump has an axial cylindrical passageway in the lower end of the body and a hollow rod is held by the passageway and extends at its lower extremity below the bottom of the cylindrical body. The upper end of the hollow rod extends into the cylindrical bore. Piston means are affixed to the hollow rod near the upper end thereof and when a finger or other object is placed over the lower end of the hollow rod and the hollow rod is moved upwardly, air is forced out of the air exit. Gasoline entering the air exit passes through the hollow rod and outside of the carburetor.

DESCRIPTION OF THE PREFERRED EMBODIMENTS

Figure 1:
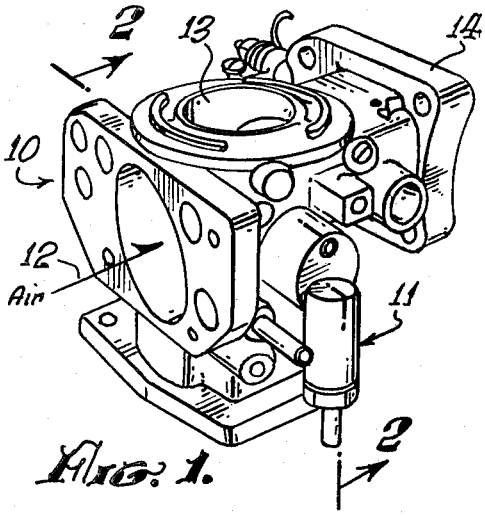
FIG. 1 is a perspective view of a carburetor having the gasoline priming pump of the present invention attached thereto.
Figure 2:
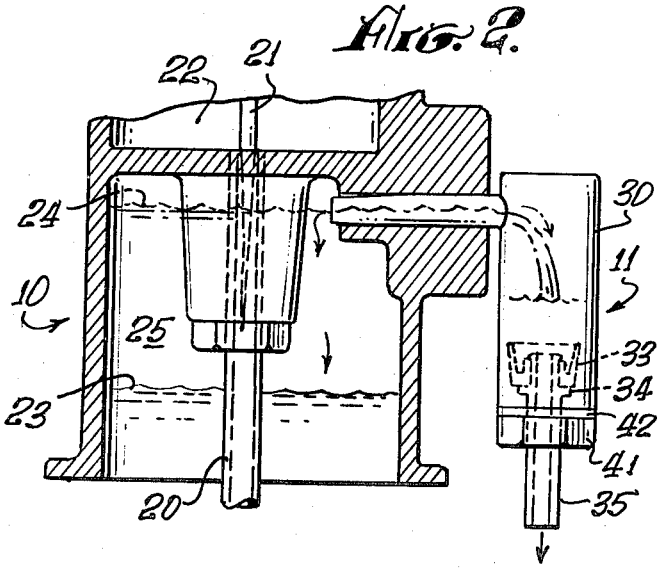
FIG. 2 is an enlarged fragmentary cross-sectional view taken along line 2—2 of FIG. 1.

A carburetor generally indicated by reference character 10 has a priming pump 11 attached to the side thereof. The carburetor is of the general type referred to as a side-draft carburetor, and air passes through an air cleaner (not shown) in the direction of the arrow indicated by reference character 12. The carburetor shown is of the type manufactured by British SU and has a variable venturi which is operated by a piston located above chamber 13. Flange 14 is bolted to the intake manifold of a motorcycle or other motor. The carburetor having the priming pump of the present invention is particularly useful for motorcycles which are kick-started since the amount of air intake generated by a kick-start is rarely sufficient to initiate the flow of gasoline through the venturi and into the intake of the motorcycle. Thus, it has in the past been necessary to operate the kick-start several times before sufficient fuel has passed into the motor to permit starting of the same. As shown in FIG. 2, the gasoline passes upwardly through tube 20 and is controlled by needle valve 21 which in turn is affixed to a piston not shown. The venturi area of the carburetor is indicated by reference character 22.

The normal gasoline level is shown at 23, but when the needle sticks in the fuel seat, the gasoline will rise to level 24 shown in phantom lines in FIG. 2. When the gasoline reaches level 24, it flows outwardly through the priming pump in a manner described in more detail below.

When the gasoline is at its normal level 23, the operation of the pump will force air into chamber 25 which in turn forces gasoline upwardly through tube 20 and into the venturi area 22.

Figure 3:
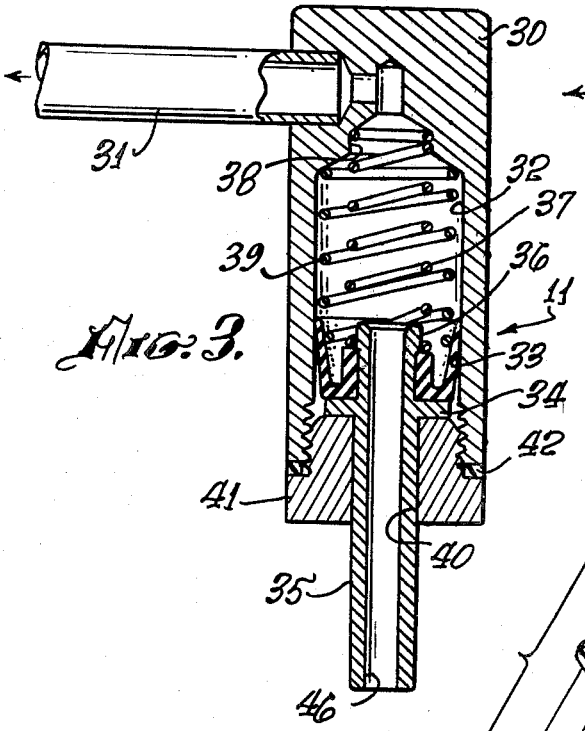
FIG. 3 is an enlarged cross-sectional view of the priming pump of the present invention.
Figure 4:
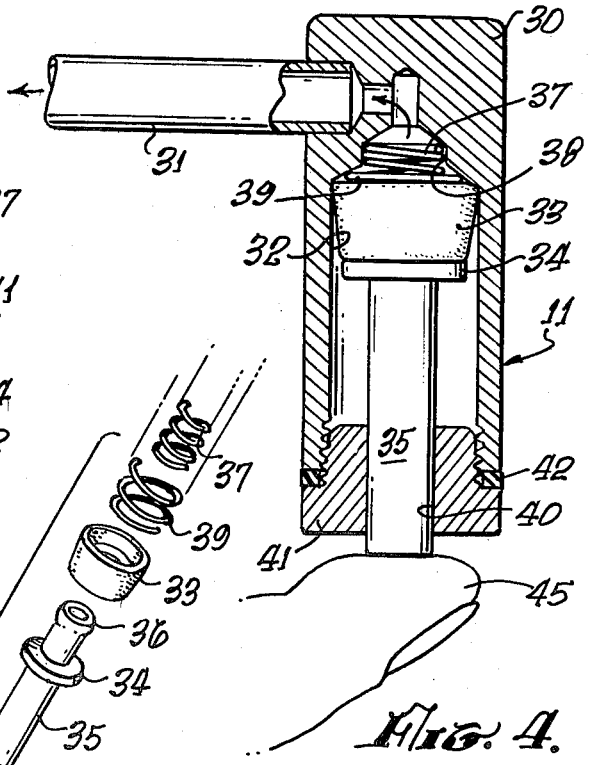
FIG. 4 is an enlarged cross-sectional view of the priming pump of the present invention.

The operation of the pump is shown in FIGS. 3 and 4. The pump has a cylindrical body 30 which is closed at the upper end and has an air exit and gasoline entry line 31 which is pressed-fit into an opening near the upper end of cylindrical body 30. Line 31 is also pressed-fit into the carburetor in the manner shown in FIG. 2. Cylindrical body 30 has an axially positioned central bore 32 which operates with a piston 33 which may be fabricated from leather or a polymer such as that sold under the trademark Viton. The important feature is that the piston 33 must be resistant to gasoline and must be sufficiently flexible to form an airtight seal with axial bore 32. Viton is a preferred material of construction. Piston 33 is held by a disc-shaped shoulder 34 which is an integral part of hollow rod 35. The upper end of rod 35 is enlarged by a ring 36 which serves to hold piston 33 on the upper end of rod 35. A helical spring 37 fits tightly over ring 36 at its lower end and into a second axial bore 38 located at the upper end of axial bore 32. A second helical inner spring 39 is held by the inner surface of piston 33 at its lower end and by the upper end of axial bore 32. This second spring is made from a relatively thin wire and is loosely wound and helps to hold the piston 33 against the wall of cylindrical bore 32 so that it will continue to provide an airtight seal with respect thereto. The second spring 39 is optional and although it is useful in holding the piston against the wall, it is not essential for operation of the present invention. The first spring 37 serves both to force the piston 33 and rod 35 downwardly, and also helps position the piston and rod in the center of bore 32.

Hollow rod 35 is held by an opening 40 formed through the center of cap 41 which is threaded into body 30. A conventional washer 42 seals cap 41 to body 30.

Figure 5:
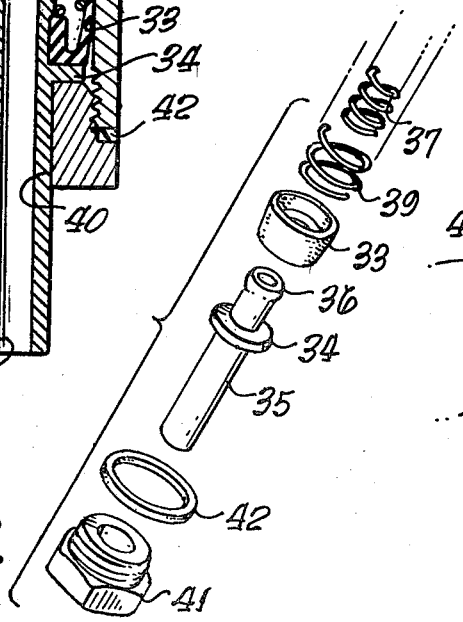
FIG. 5 is a perspective exploded view of the piston means and lower plug of the priming valve of the present invention.

The cap, hollow rod and piston parts are shown in exploded view in FIG. 5.

The operation of the pump is shown best in FIG. 4 where the operator's finger indicated by reference character 45 is placed over the lower end of hollow rod 35 and moved upwardly forcing air out of axial cylindrical bore 32 and through the air exit line 31 and into chamber 25. This forces gasoline upwardly through tube 20 around needle valve 21 and into the venturi area 22. The amount of air forced into chamber 25 is quite critical since the amount of gasoline forced into venturi area 22 should not be so much that the engine is flooded nor should it be so little that it will not start. It has been found that for most motorcycle carburetors that an air input of approximately 3/10 of a cubic inch is ideal. A cylindrical bore diameter of ½ inch and a stroke of ⅜ of an inch has proved very satisfactory.

Another important function of the present priming pump is its ability to function as safety device by draining off gasoline which fills chamber 25 when the float valve sticks in an open position. As stated briefly above when gasoline reaches the level indicated by reference character 24, it flows outwardly through line 31 and into cylindrical bore 32. From there it flows outwardly through the central opening 46 of hollow rod 35.

By providing a threaded cap 41, the user can disassemble the pump and replace the piston 33 or either of the springs in the event that this ever becomes necessary. While the piston 33 and associated hollow rod 35 would tend to move downwardly without the use of any biasing means, the use of spring 37 greatly facilitates this. While spring 37 is shown within axial bore 32, it could alternatively be located below cap 41 although the location shown in the drawing is preferred.

While the pump of the present invention is particularly useful for motorcycle carburetors, it also is useful on other devices such as chain saws, lawn mowers and the like. It is preferable that the carburetor be easily accessible to the person starting the engine.

The present embodiments of this invention are thus to be considered in all respects as illustrative and not restrictive; the scope of the invention being indicated by the appended claims rather than by the foregoing description. All changes which come within the meaning and range of equivalency of the claims therefore are intended to be embraced therein.

I claim:

1. A carburetor having a combination gasoline priming pump and gasoline overflow drain, said carburetor comprising:

a carburetor body having a gasoline reservoir chamber;

a gasoline priming pump air exit and gasoline entry line affixed to and extending through said gasoline reservoir chamber at a level above the normal gasoline level but below the level of gasoline when the chamber is overfilled with gasoline;

a cylindrical body affixed to said line, said body having an axial cylindrical bore, said bore being closed at its upper end, said line passing through the wall of said cylindrical body near the upper end of the body;

an axial, cylindrical passageway in the lower end of said body;

a hollow rod held by said passageway and extending at its lower extremity below the bottom of said clyindrical body and extending into said cylindrical bore; and piston means affixed to the hollow rod near the upper end thereof whereby when a finger is placed over the lower end of said hollow rod and said hollow rod is moved upwardly, air is forced out of said air exit and gasoline entry line.

2. The carburetor of claim 1 wherein said axial cylindrical bore is about ½ inch in diameter and wherein the stroke of said piston is about ⅜ of an inch.

3. The carburetor of claim 1 wherein said body has a threaded cap at the bottom thereof.

4. The carburetor of claim 1 wherein said piston is a Viton cup.

5. The carburetor of claim 4 wherein said biasing means is a helical spring and further including a second helical spring positioned near the inner surface of said bore and held at its lower end by the inner surface of said piston means.

6. The carburetor of claim 1 further including biasing means urging the hollow rod downwardly.

7. The carburetor of claim 6 wherein said biasing means comprises a helical spring.

8. The carburetor of claim 7 wherein said hollow rod has a widened upper end extending into said bore and forming a platform for the lower end of the helical spring.

9. The carburetor of claim 8 further including a second helical spring positioned near the inner surface of said bore and held at its lower end by the inner surface of said piston.

10. The carburetor of claim 9 wherein said piston is a polymeric cup having a piston-spreading spring positioned on the inner wall thereof, said spring extending upwardly to the upper end of said cylindrical bore.

* * * * *